US009165733B2

(12) United States Patent
Reuber et al.

(10) Patent No.: US 9,165,733 B2
(45) Date of Patent: Oct. 20, 2015

(54) CIRCUIT BREAKER ARRANGEMENT FOR MEDIUM VOLTAGE TO HIGH VOLTAGE APPLICATIONS

(75) Inventors: Christian Reuber, Willich (DE); Dietmar Gentsch, Ratingen (DE)

(73) Assignee: ABB TECHNOLOGY AG, Zurich (CH)

( * ) Notice: Subject to any disclaimer, the term of this patent is extended or adjusted under 35 U.S.C. 154(b) by 610 days.

(21) Appl. No.: 13/311,072

(22) Filed: Dec. 5, 2011

(65) Prior Publication Data

US 2012/0168291 A1 Jul. 5, 2012

(30) Foreign Application Priority Data

Dec. 3, 2010 (EP) ..... 10015280

(51) Int. Cl.
*H01H 33/662* (2006.01)

(52) U.S. Cl.
CPC ... *H01H 33/66207* (2013.01); *H01H 33/66261* (2013.01); *H01H 2033/6623* (2013.01); *H01H 2033/66223* (2013.01); *H01H 2033/66284* (2013.01)

(58) Field of Classification Search
CPC .... H01H 33/66; H01H 33/662; H01H 33/666
USPC ..... 218/10, 14, 134, 136, 139, 140, 118; 200/302.2
See application file for complete search history.

(56) References Cited

U.S. PATENT DOCUMENTS 4,417,110 A 11/1983 Yanagisawa et al.
6,364,216 B1 * 4/2002 Martin ..... 439/181
6,770,832 B2 * 8/2004 Marchand et al. ..... 218/140
6,927,355 B2 * 8/2005 Thuresson et al. ..... 218/84
8,434,767 B2 * 5/2013 Takeshita et al. ..... 277/630
2010/0181291 A1 7/2010 Gentsch

FOREIGN PATENT DOCUMENTS

DE 2461607 A1 7/1975
FR 2920251 A1 2/2009
WO WO 2009/043361 A1 4/2009

OTHER PUBLICATIONS

European Search Report issued on May 23, 2011, European Application No. 10015280.0.

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

Exemplary embodiments are directed to a circuit breaker arrangement for medium voltage to high voltage applications. The circuit breaker includes at least one pole part housing for accommodating a vacuum insert, within which a pair of corresponding electrical contacts is coaxially arranged. A fixed electrical contact is electrically connected to an upper terminal of the pole part housing and an axial movable electrical contact is electrically connected to a lower terminal of the pole part housing and is operated by an insulating pushrod. The insulating pushrod extends through a shielding plate arranged on a lower opening of the pole part housing. The shielding plate includes a rigid moulded plastic insulating material. At least one sealing ring has an elastic material moulded on the periphery of the shielding plate.

19 Claims, 3 Drawing Sheets

CIRCUIT BREAKER ARRANGEMENT FOR MEDIUM VOLTAGE TO HIGH VOLTAGE APPLICATIONS

This application claims priority under 35 U.S.C. §119 to European Patent Application No. 10015280.0 filed in Europe on Dec. 3, 2010, the entire content of which is hereby incorporated by reference in its entirety.

FIELD

The present invention relates to circuit breakers, such as a circuit breaker arrangement for medium voltage to high voltage applications.

BACKGROUND

Known circuit breaker arrangements can be used for medium voltage applications ranged between 1 and 72 kV of a high current level. These circuit breakers can be used in electrical networks to interrupt short circuit currents as well as load currents under difficult load impedances. The vacuum insert of the medium voltage circuit breaker can interrupt the current by creating and extinguishing the arc in a closed vacuum container. Known vacuum circuit breakers can have a longer life expectancy than air circuit breakers. Moreover, current interruption with vacuum means is one technology that can be used at a high voltage level. Shielding means and grounding means can be used as safety measures.

The document WO 2009/043361 A1 discloses a pole part of a medium voltage circuit breaker. A vacuum insert containing a pair of corresponding electrical contacts is embedded in insulating fashion in an epoxy resin encapsulation. The upper electrical contact within the vacuum interrupter chamber is fixed while the lower electrical contact within the vacuum interrupter chamber is movable. The movable electrical contact is passed to the outside via bellows and can be moved by an axial movable jackshaft. In order to create the electrical transmission between the lower movable electrical contact and the corresponding lower terminal, a metallic electrically conductive connection is provided between a push rod of the movable electrical contact and the outer terminal. That metallic electrically conductive connection includes a piston, which runs movable within a metallic electrically conductive cylinder which is moulded in the insulating housing of the pole part and which forms said upper terminal of the pole part.

The insulating housing of the pole part is open at the bottom in a known manner. The pole part can be connected on a mounting surface of a gear housing at the bottom side by screwing. The gear housing is provided for accommodating the jackshaft arrangement for operating the push rod of one or more pole parts mounted thereon.

In circuit breaker arrangements, the distance between high voltage parts and grounded parts can be so short that additional means are specified to realize the highest insulation voltages that are requested by the industrial standards. Some standards additionally specify creepage distances that are longer than the distance between the high voltage parts and the grounded parts.

SUMMARY

An exemplary circuit breaker arrangement for medium voltage to high voltage applications, comprising: at least one pole part housing for accommodating a vacuum insert having a pair of corresponding coaxially arranged electrical contacts, wherein a fixed electrical contact is electrically connected to an upper terminal of the pole part housing and an axial movable electrical contact is electrically connected to a lower terminal of the pole part housing and is operated by an insulating pushrod, wherein the insulating pushrod extends through a shielding plate arranged on a lower opening of the pole part housing, the shielding plate includes a rigid moulded plastic insulating material, wherein at least one sealing ring has an elastic material moulded on the periphery of the shielding plate.

An exemplary vacuum interrupter arrangement, comprising: at least one pole part housing for accommodating a vacuum insert having a pair of corresponding coaxially arranged electrical contacts, wherein a fixed electrical contact is electrically connected to an upper terminal of the pole part housing and an axial movable electrical contact is electrically connected to a lower terminal of the pole part housing and is operated by an insulating pushrod, wherein the insulating pushrod extends through a shielding plate arranged on a lower opening of the pole part housing, the shielding plate includes a rigid moulded plastic insulating material, wherein at least one sealing ring has an elastic material moulded on the periphery of the shielding plate, and wherein an inner side of the shielding plate includes concentric ring shaped ribs for increasing the creepage distance.

BRIEF DESCRIPTION OF THE DRAWINGS

Below, embodiments of the present invention are described in more detail with reference to the attached drawings.

The reference symbols used in the drawings, and their meanings, are listed in summary form in the list of reference symbols. In principle, identical parts are provided with the same reference symbols in the figures. All the figures are schematic as mentioned above.

DETAILED DESCRIPTION

Figure 1:
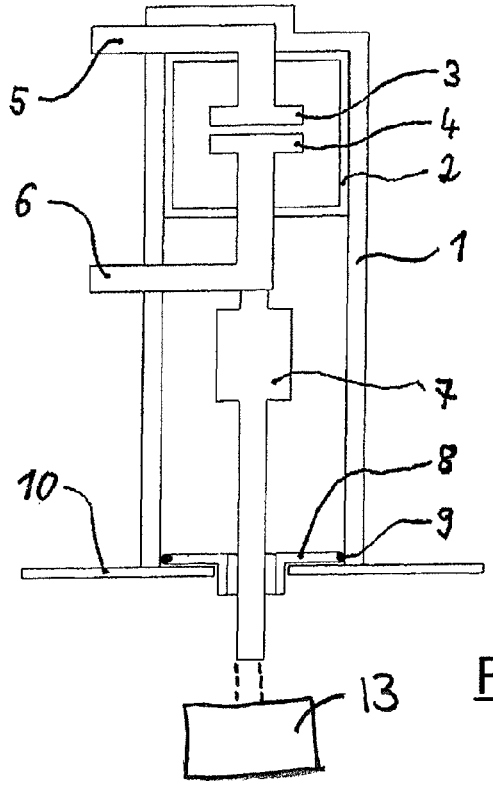
FIG. 1 shows a side view of a vacuum interrupter arrangement in accordance with an exemplary embodiment of the present disclosure.

An exemplary circuit breaker of the present disclosure can include at least one pole part housing for accommodating a vacuum insert, within which a pair of corresponding electrical contacts is coaxially arranged, wherein the fixed electrical contact is electrically connected to an upper terminal of the pole part and an axial movable electrical contact is electrically connected to a lower terminal of the pole part and is operated by an insulating push rod extending through a shielding plate arranged on a lower opening area of the pole part housing.

Exemplary embodiments of the present disclosure provide a circuit breaker arrangement with an effective shielding means between the pole part housing as a high voltage part and the gear housing as the adjacent grounded part.

According to exemplary embodiments disclosed herein, the insulating push rod for operating the lower movable electrical contact extends through a special shielding plate, which is arranged on the bottom of the pole part housing. The specific shielding plate can include (e.g., consist of) a rigid moulded plastic insulating material, wherein at least one sealing ring consisting of an elastic material is directly moulded on the periphery of the shielding plate.

Thus, the exemplary embodiments can provide a high insulation standard and increase the creepage distance due to the sealing effect between the specific shielding plate and the inner wall of the corresponding opening section of the pole part housing. The shielding plate can be made of insulating material and covers the edges of the lower opening of the pole part housing in order to prevent flashovers between the lower electrical terminal and the edges of the pole part housing. The shielding plate can be a moulded plastic part, which can be less complex to manufacture. Since the sealing ring is directly moulded onto the edge of the shielding plate, the exemplary embodiments provide a one-piece part solution, which is safe and less complex to assemble on the pole part housing.

In another exemplary embodiment, a specific shielding plate with an integrated sealing ring can be used. The specific sealing ring can be made in two consecutive steps in the same injection moulding tool, using a harder plastic material for the plate section and a softer material for the sealing section.

In an exemplary embodiment of the present disclosure, concentric ring-shaped ribs can be moulded on the inner side of the shielding plate. These concentric ring-shaped ribs increase the creepage distance between the high voltage parts and the grounded parts of the vacuum interrupter arrangement. The additional ribs can be provided by using additional hard plastic material, for example.

The length of the ribs does not have to be equal. Some ribs can be extended over the length of several shorter ribs in order to increase the creepage length accordingly.

To increase the reliability of the sealing, several parallel sealing rings can be used. In an exemplary embodiment, two sealing rings can be arranged parallel on the periphery of the shielding plate and spaced by a small distance from one another.

Preferably, the sealing ring is provided with a concave cross-section. In another embodiment the at least one sealing ring is provided with a bevelled cross-section in order to facilitate insertion into the opening of the pole part housing.

In another exemplary embodiment of the present disclosure, the at least two sealing rings can be interconnected one to another via a common sealing body section. Thus, the common sealing ring is more elastic and provides a safe sealing function between the shielding plate and the surrounding pole part housing.

In an exemplary embodiment of the present disclosure, the sealing ring can be arranged at or around the corner area of the shielding plate. For example, the sealing ring can be arranged at the inner peripheral corner of the shielding plate to get a reliable sealing function.

The sealing ring can provide a cylindrical-shaped contact surface with the inner wall of the pole part housing in the mounted stage, since the elastic material of the sealing ring is compressed. Alternatively, it is also possible to design the sealing ring as a lip-seal having at least one sealing lip extending radial outwardly from the periphery of the shielding plate.

Exemplary embodiments disclosed herein are applicable not only to vacuum circuit breakers, but also for modern SF6 circuit breakers having a chamber filled with sulphur hexafluoride gas.

FIG. 1 shows a side view of a vacuum interrupter arrangement in accordance with an exemplary embodiment of the present disclosure. As shown in FIG. 1, a circuit breaker arrangement for a medium voltage application includes (e.g., consists of) a pole part housing 1 made of plastic insulating material, which accommodates a vacuum insert 2. Inside the vacuum, insert 2 a pair of corresponding electrical contacts 3 and 4 is coaxially arranged to form an electrical switch.

For switching, a fixed electrical contact 3 is electrically connected to a corresponding upper terminal 5 moulded in the pole part housing 1. The fixed electrical contact 3 can correspond with a movable electrical contact 4, which is electrically connected to a corresponding lower terminal 6 of the pole part housing 1. An insulating push rod 7 is provided for axial movement of the movable electrical contact 4.

The insulating push rod 7 includes (e.g., consists of) an insulating material and extends from the movable electrical contact 4 passing a bellow (not shown) through a central opening of a shielding plate 8. The specific shielding plate 8 is arranged on the lower opening of the pot-shaped pole part housing 1. The insulating push rod 7 ends inside a circuit breaker housing 10. The circuit breaker housing 10 accommodates gear means 13 for operating the push rod 7 in a known manner. The circuit breaker housing 10 includes (e.g., consists of) metal material and is electrically grounded. The specific shielding plate 8 separates that grounded part from the high voltage part inside the pole part housing 1. Therefore, the shielding plate 8 includes (e.g., consists of) a rigid moulded plastic insulating material, wherein at least one sealing ring 9 including (e.g., consisting of) an elastic material which is directly moulded on the periphery of the shielding plate 8.

Figure 2:
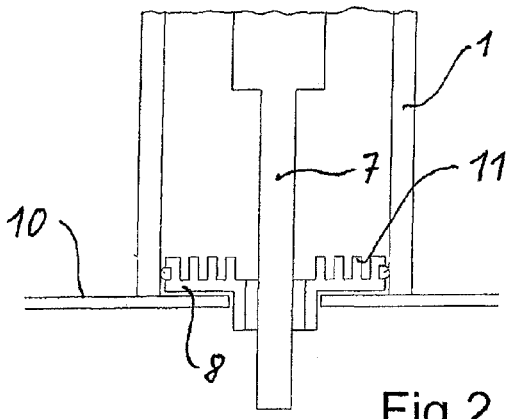
FIG. 2 shows a detailed side view in a section of a second specific shielding plate in accordance with an exemplary embodiment of the present disclosure.

FIG. 2 shows a detailed side view in a section of a second specific shielding plate in accordance with an exemplary embodiment of the present disclosure. As shown in FIG. 2 the shielding plate 8 is additionally provided with concentric ring-shaped ribs 11 for increasing the creepage distance between the high voltage part and the grounded part. In that embodiment all ring-shaped ribs 11 have the same length.

Figure 3:
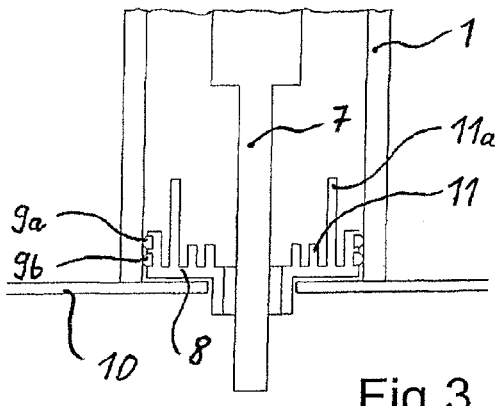
FIG. 3 shows a detailed side view in a section of a third specific shielding plate in accordance with an exemplary embodiment of the present disclosure.

FIG. 3 shows a detailed side view in a section of a third specific shielding plate in accordance with an exemplary embodiment of the present disclosure. As shown in FIG. 3, one ring-shaped rib 11*a* extending over the length of the other ring-shaped ribs 11, which are relatively shorter in length.

Figure 4:
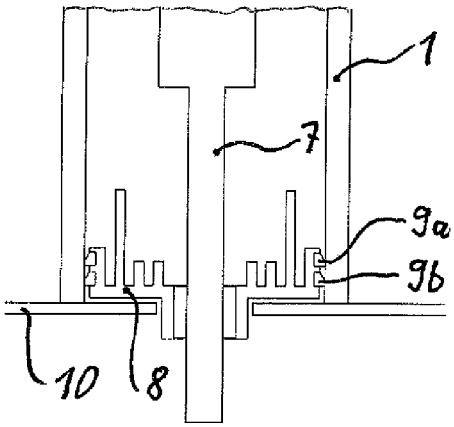
FIG. 4 shows a detailed side view in a section of a fourth specific shielding plate in accordance with an exemplary embodiment of the present disclosure.

FIG. 4 shows a detailed side view in a section of a fourth specific shielding plate in accordance with an exemplary embodiment of the present disclosure. As shown in FIG. 4, the shielding plate 8 is provided with two separate sealing rings 9*a* and 9*b*, which are, arranged parallel one to another in order to increase the sealing function.

Figure 5:
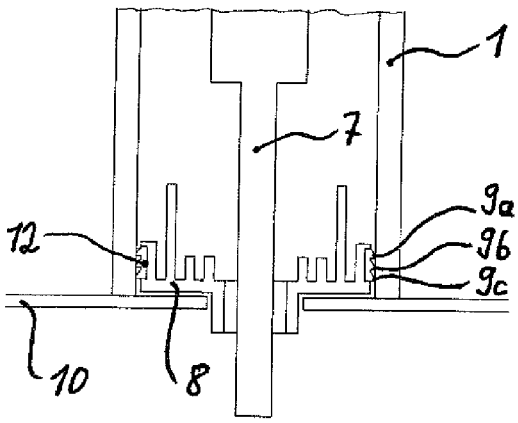
FIG. 5 shows a detailed side view in a section of a fifth specific shielding plate in accordance with an exemplary embodiment of the present disclosure.

FIG. 5 shows a detailed side view in a section of a fifth specific shielding plate in accordance with an exemplary embodiment of the present disclosure. As illustrated in FIG. 5, three sealing rings 9*a*-9*c* are interconnected one to another via common sealing body section 12. Furthermore, the sealing rings 9*a*-9*c* are provided with a bevelled cross-section in order to facilitate insertion into the bottom opening of the pole part housing 1.

Figure 6:
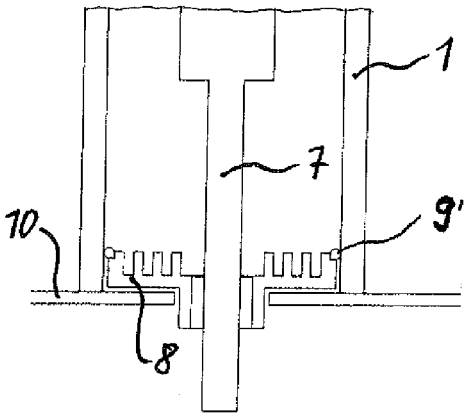
FIG. 6 shows a detailed side view in a section of a sixth specific shielding plate in accordance with an exemplary embodiment of the present disclosure.

FIG. 6 shows a detailed side view in a section of a sixth specific shielding plate in accordance with an exemplary embodiment of the present disclosure. As shown in FIG. 6, the small sealing ring 9' is arranged at the upper corner area of the shielding plate 8.

Figure 7:
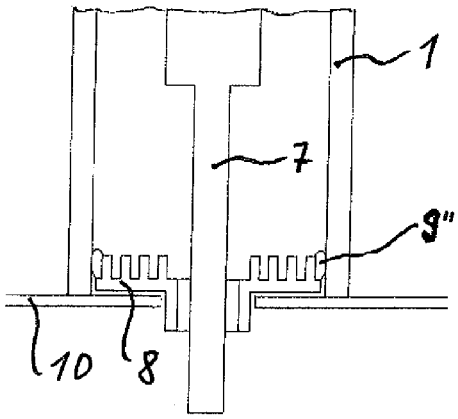
FIG. 7 shows a detailed side view in a section of a seventh specific shielding plate in accordance with an exemplary embodiment of the present disclosure.

FIG. 7 shows a detailed side view in a section of a seventh specific shielding plate in accordance with an exemplary embodiment of the present disclosure. As illustrated in FIG. 7, a sealing ring 9" is arranged in the upper corner area of the shielding plate 8, which provides a cylindrical-shaped contact surface with the inner wall of the pole part housing 1.

Figure 8:
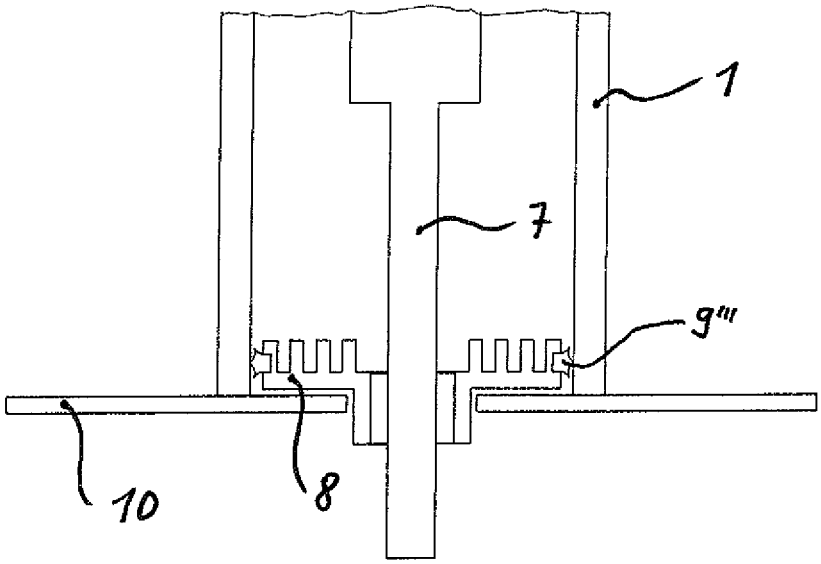
FIG. 8 shows a detailed side view in a section of an eighth specific shielding plate in accordance with an exemplary embodiment of the present disclosure.

FIG. 8 shows a detailed side view in a section of an eighth specific shielding plate in accordance with an exemplary embodiment of the present disclosure. As shown in FIG. 8, the sealing ring 9''' is a lip-seal including three sealing lips on the outer periphery.

Figure 9:
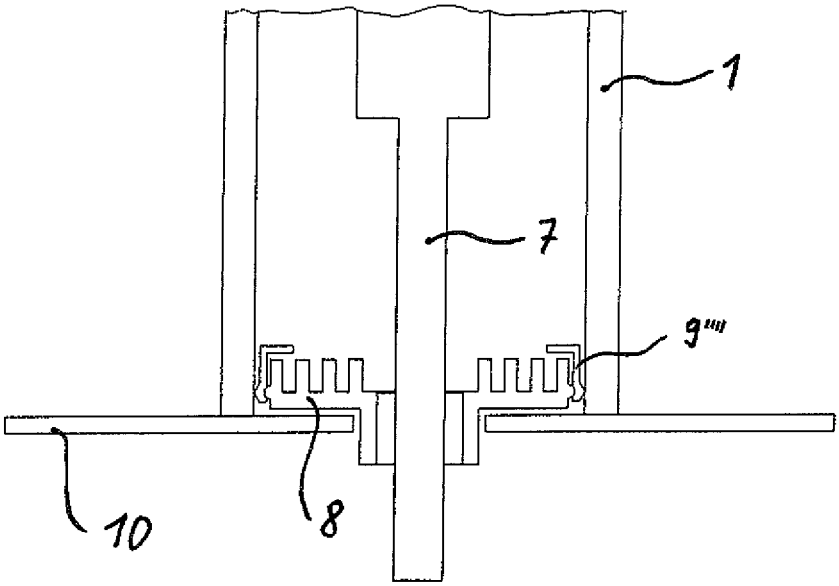
FIG. 9 shows a detailed side view in the section of a ninth specific shielding plate in accordance with an exemplary embodiment of the present disclosure.

FIG. 9 shows a detailed side view in the section of a ninth specific shielding plate in accordance with an exemplary embodiment of the present disclosure. As shown in FIG. 9, the sealing ring 9'''' is arranged around the upper corner area of the shielding plate 8. As a result, the sealing ring 9'''' has an L-shaped cross-section, which surrounds the upper corner of the shielding plate 8.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art and practicing the claimed invention, from the study of the drawings, the disclosure and the appended claims.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE SYMBOLS

1 Pole part housing
2 Vacuum insert
3 Fixed electrical contact
4 Movable electrical contact
5 Upper terminal
6 Lower terminal
7 Insulating push rod
8 Shielding plate
9 Sealing ring
10 Circuit breaker housing
11 Ring-shaped ribs
12 Common sealing body section

What is claimed is:

1. A circuit breaker arrangement for medium voltage to high voltage applications, comprising:

at least one pole part housing for accommodating a vacuum insert having a pair of corresponding coaxially arranged electrical contacts, wherein a fixed electrical contact is electrically connected to an upper terminal of the pole part housing and an axial movable electrical contact is electrically connected to a lower terminal of the pole part housing and is operated by an insulating pushrod, wherein the insulating pushrod extends through a shielding plate arranged on a lower opening of the pole part housing, the shielding plate includes a rigid moulded plastic insulating material, wherein the shielding plate includes a plurality of ring shaped ribs, and wherein at least one sealing ring has an elastic material moulded on the periphery of an outermost ring-shaped rib of the shielding plate.

2. The circuit breaker arrangement according to claim 1, wherein at least one longer ring shaped rib extends over the length of several shorter ring shaped ribs.

3. The circuit breaker arrangement according to claim 1, wherein at least two sealing rings are parallel arranged on the periphery of the shielding plate.

4. The circuit breaker arrangement according to claim 1, wherein the at least one sealing ring includes a bevelled cross section to facilitate insertion into the opening of the pole part housing.

5. The circuit breaker arrangement according to claim 3, wherein the at least two sealing rings are interconnected one to another via a common sealing body section.

6. The circuit breaker arrangement according to claim 1, wherein the sealing ring is arranged at or around the corner area of the shielding plate.

7. The circuit breaker arrangement according to claim 1, wherein the sealing ring forms a cylindrical shaped contact surface with the inner wall of the pole part housing.

8. The circuit breaker arrangement according to claim 1, wherein the sealing ring is a lip-seal.

9. The circuit breaker arrangement according to claim 1, wherein the pole part housing is mounted on a grounded metal circuit breaker housing having gear means for operating the pushrod.

10. A vacuum interrupter arrangement, comprising:

at least one pole part housing for accommodating a vacuum insert having a pair of corresponding coaxially arranged electrical contacts, wherein a fixed electrical contact is electrically connected to an upper terminal of the pole part housing and an axial movable electrical contact is electrically connected to a lower terminal of the pole part housing and is operated by an insulating pushrod, wherein the insulating pushrod extends through a shielding plate arranged on a lower opening of the pole part housing, the shielding plate includes a rigid moulded plastic insulating material, wherein an inner side of the shielding plate includes concentric ring shaped ribs for increasing the creepage distance, and wherein at least one sealing ring has an elastic material moulded on a periphery of an outermost rib of the shielding plate.

11. The vacuum interrupter arrangement according to claim 10, wherein at least one longer ring shaped rib extends over the length of several shorter ring shaped ribs.

12. The vacuum interrupter arrangement according to claim 10, wherein at least two sealing rings are parallel arranged on the periphery of the shielding plate.

13. The vacuum interrupter arrangement according to claim 10, wherein the at least one sealing ring includes a bevelled cross section to facilitate insertion into the opening of the pole part housing.

14. The vacuum interrupter arrangement according to claim 12, wherein the at least two sealing rings are interconnected one to another via a common sealing body section.

15. The vacuum interrupter arrangement according to claim 10, wherein the sealing ring is arranged at or around the corner area of the shielding plate.

16. The vacuum interrupter arrangement according to claim 10, wherein the sealing ring forms a cylindrical shaped contact surface with the inner wall of the pole part housing.

17. The vacuum interrupter arrangement according to claim 10, wherein the sealing ring is a lip-seal.

18. The vacuum interrupter arrangement according to claim 10, wherein the pole part housing is mounted on a grounded metal circuit breaker housing having gear means for operating the pushrod.

19. The vacuum interrupter arrangement according to claim 1, wherein the vacuum insert is located in a first area of the at least one pole part housing, and the lower opening is arranged in a second area of the at least one pole part housing.

* * * * *